United States Patent [19]

Lalezari et al.

[11] Patent Number: 4,843,403

[45] Date of Patent: Jun. 27, 1989

[54] BROADBAND NOTCH ANTENNA

[75] Inventors: Farzin Lalezari; Charles G. Gilbert, both of Louisville; John M. Rogers, Boulder, all of Colo.

[73] Assignee: Ball Corporation, Muncie, Ind.

[21] Appl. No.: 79,182

[22] Filed: Jul. 29, 1987

[51] Int. Cl.[4] ..... H01Q 1/38; H01Q 13/00

[52] U.S. Cl. ..... 343/767; 343/700 MS

[58] Field of Search ..... 343/700 MS, 708, 767, 343/770, 795, 803, 807

[56] References Cited

U.S. PATENT DOCUMENTS

| | | | |
|---|---|---|---|
| 2,895,133 | 7/1959 | Choquer et al. | 343/767 |
| 2,944,258 | 7/1960 | Yearat et al. | 343/767 |
| 2,990,547 | 6/1961 | McDougal | 343/767 |
| 3,501,767 | 3/1970 | Velez | 343/795 |
| 4,001,834 | 1/1977 | Smith | 343/795 |
| 4,015,265 | 3/1977 | Dubost et al. | 343/803 |
| 4,500,887 | 2/1985 | Nester | 343/700 MS |

*Primary Examiner*—William L. Sikes
*Assistant Examiner*—Doris J. Johnson
*Attorney, Agent, or Firm*—Gilbert E. Alberding

[57] ABSTRACT

The subject invention relates to an antenna having broadband characteristics. The antenna is a dual notch device capable of receiving or transmitting electromagnetic waves comprising a substrate, an upper planer conducting antenna element disposed on one side of the surface of said substrate and having a first curved edge, a second conducting antenna element disposed on the other side of said substrate and having a second curved edge, said first and second curved edges being closely related to one another and spaced apart in close proximity at one point to define a feed-point therebetween with adjacent curved edges gradually tapering outwardly therefrom to define flared notches interfacing one another and interconnected by said gap.

12 Claims, 7 Drawing Sheets

10 GHz

6 GHz

10 GHz

6 GHz

BROADBAND NOTCH ANTENNA

BACKGROUND OF THE INVENTION

This invention relates to an antenna structure, and, more particularly, a novel conformal antenna structure having broadband characteristics as well as a radiation pattern and impedance characteristics that are essentially independent of frequency over a wide range.

In designing antenna structures, it should be kept in mind that the antenna designer must make the antenna perform a desired electrical function such as transmitting/receiving linearly polarized, right-hand circularly polarized, left-hand circularly polarized, etc., r.f. signals with appropriate gain, bandwidth, beamwidth, minor lobe level, radiation efficiency, aperture efficiency, receiving cross section, radiation resistance and other electrical characteristics. It is also necessary for these structures to be lightweight, simple in design, inexpensive and unobtrusive since an antenna is often required to be mounted upon or secured to a supporting structure or vehicle such as high velocity aircraft, missiles, and rockets which cannot tolerate excessive deviations from aerodynamic shapes. Of course, it is also sometimes desirable to hid the antenna structure so that its presence is not readily apparent for aesthetic and/or security purposes. Accordingly, the ideal electrical antenna should physically be very thin and not protrude on the external side of a mounting surface, such as an aircraft skin or the like, while yet still exhibiting all the requisite electrical characteristics.

Antennas that have very low profiles which may be flush mounted on a supporting surface are generally referred to as conformal antennas. As discussed, such an antenna must actually conform to the contour of its supporting surface, and, therefore, reduce or eliminate any turbulent effects that would result when such a device is mounted or secured to a vehicle and propelled through space. Conformal antennas may, of course, be constructed by several methods, but can be generally produced by rather simple photoetching techniques since such techniques offer ease of fabrication at a relatively low production cost.

Such conformal antennas or printed circuit board antennas, as they may be called, are formed by etching a single side of a unitary metallically clad dielectric sheet or electrodeposited film using conventional photoresist-etching techniques. Typically, the entire antenna structure may possibly be on 1/32 inch to ⅛ inch thick which minimizes cost and maximizes manufacturing/operating reliability and reproducibility. It can be appreciated that the cost of fabrication is substantially minimized since single antenna elements and/or arrays of such elements together with appropriate r.f. feedlines, phase shifting circuits and/or impedance matching networks may all be manufactured as integrally formed electrical circuits alone using low cost photoresist-etching processes commonly used to make electronic printed circuit boards. This is to be compared with many complicated and costly prior art techniques for achieving polarized radiation patterns as, for instance, a turnstile dipole array, the cavity backed turnstile slot array and other types of special antennas.

A resonant antenna is one which is an integral number of half-wavelengths. In a resonant antenna standing waves of current and voltage are established causing the maximum amount of radiated energy to be radiated as the antenna reactance for a particular frequency is lowest. Of course, an antenna need not exhibit resonant properties to operate satisfactorily. An antenna may operate and be designed to have approximate uniform current and voltage amplitudes along its length. Such an antenna is generally characterized as a traveling wave antenna and is nonresonant.

In general, an antenna is limited in the range of frequencies over which it effectively operates. An antenna may operate satisfactorily, of course, within a fixed frequency range with a signal that is narrower in its bandwidth and, generally, in the design of such an antenna there are no particular bandwidth problems. On the other hand, if a broadband antenna is required, there are often a number of difficulties that an antenna designer must overcome to produce a satisfactory operating antenna device. Under certain conditions, it is possible in a number of applications to actually use an essentially narrow-band antenna over a wide frequency range if allowance and provisions are actually made for modifying the antenna's dimensional characteristics or for adjusting the impedance matching transformer characteristics of the antenna. In many operations, however, it is necessary that an antenna structure having a fixed configuration operate over a very broad range of frequencies. Accordingly, a number of broadbanding techniques have been practiced to achieve this goal since an antenna having a broad bandwidth is highly desirable.

In considering bandwidth, there are generally two categories of parameters to be addressed: (1) the antenna radiation pattern, and (2) impedance characteristics. As regards the radiation pattern, parameters to be considered for designing a broadband antenna include the power gain, beamwidth, side-lobe level, beam direction and polarization and, as regards the impedance characteristics, parameters to be considered include input impedance, radiation resistance and antenna efficiency.

With respect to a resonant antenna, resistive loading of such an antenna provides a means to broaden its impedance bandwidth. In this regard, broadband dipole antennas have been made by making the thickness of the conducting element large relative to their length. Thus, broadbanding dipole structures have been simply accomplished by employing large diameter conductors rather than thinner ones. In this regard, biconical antennas belong to this general class and are generally considered to be broadband antennas. Nonetheless, resistive loading is not generally employed for antennas operating at high frequencies since conductor losses are usually exceeding small which, in turn, results in an antenna having an inadequate bandwidth.

Certain antennas having a wide variety of physical sizes and shapes are known to be frequency independent, often achieving bandwidths of at least 10 to 1 and substantially higher. In general, their broadband behavior includes both impedance and radiation pattern characteristics. Such frequency independent antennas, as they are called, generally exhibit a certain shape or pattern of geometric form. For such antennas there are certain structural patterns that are more or less repeated with changing dimensions. An illustrative example of this design characteristic is found in the so-called log-periodic dipole array antenna.

Although a number of such antennas are known and include the Beverage antenna or wave antenna, the rhombic antenna and the aforementioned log-periodic antenna, all these devices are relatively large and require substantial space.

U.S. Pat. No. 2,942,263 to Baldwin teaches a conventional notch antenna device. Further, U.S. Pat. No. 2,944,258 to Yearout, et al., discloses a dual-ridge antenna having a broad bandwidth. U.S. Pat. No. 2,985,879 to Du Hamel discloses a frequency independent antenna. The Du Hamel antenna is formed of a conducting material having an outline of a pair of intersecting lines serve at the feed point. The edges of the antenna are provided with a plurality of alternating slots and teeth that are dimensioned proportionally to their distance from the feed point. U.S. Pat. No. 3,836,976 to Monser, et al., disclosed a broadband phase array antenna formed by pairs of mutually orthogonal printed radiating elements, each one of such elements having a flared notch formed therein. Further, U.S. Pat. No. 4,500,887 to Nester discloses a broadband radiating element designed to provide a smooth, continuous transition from a microstrip feed configuration to a flared notch antenna.

A conventional notch antenna device 10 is shown in FIG. 1 and consists of a metallization 11 situated on and integrally connected to a dielectric substrate 13. The notch antenna device 10 has a mount 14 and a narrow slot 15 that are interconnected by a gradual transition as shown in FIG. 1. It is to be noted that a cavity 16 is formed at the base of the slot line 15, the cavity 16 being required for impedance matching the antenna to a transmission line. The cavity 16 places, nonetheless, a limitation on the ratio of high to low frequencies that the notched antenna device 10 can properly receive or transmit. The radiation pattern is unidirectional and generally provides bandwidth usually not exceeding about 4:1.

BRIEF SUMMARY OF THE INVENTION

It is the object of this invention to provide an improved conformal antenna element having simplicity of design and ease of fabrication.

It is another object of the invention to provide an improved notch radiating element of novel configuration that is frequency independent, especially over the microwave range, and that can be used as a directive antenna either alone or in an array.

It is yet another object of the subject invention to provide a novel broadband antenna device of compact design and relatively small in volume.

It is another object of this invention to provide a new flared notch antenna of compactness of symmetrical design that eliminates geometric discontinuities therefrom capable of broadband performance both for impedance match and for radiation pattern characteristics.

It is another object of the instant invention to provide a broadband array adopted to operate in one of a number of polarizations.

These and other objects of the invention are attained by provided an antenna structure for receiving and transmitting electromagnetic waves comprising a dielectric substrate, a first metallization disposed on said substrate and having a first curved edge and second metallization disposed on said substrate and having a second curve edge, said first and second curved edges being closely related to one another and spaced apart to define a gap with adjacent curved edges gradually tapering therefrom to defined two flared notches emanating from said gap.

One preferred embodiment of the subject invention is an antenna structure for receiving and transmitting electromagnetic waves comprising a dielectric substrate, a first conducting antenna element disposed on one side of the surface of said substrate and having a first curved edge, a second conducting antenna element disposed on the other side of the same surface of said substrate and having a second curved edge closely related to the first, said first and second curved edges being spaced apart in close proximity to one another at one point to define a feed point gap therebetween, said first and second conducting antenna elements having their respective curved edges so arranged so that their curved edges gradually taper outwardly from said feed point gap to define flared notches interconnected by said feed point gap.

From another point of view, the subject invention relates to a radiating device comprising a dielectric substrate, an upper planer conducting antenna element disposed on one side of the surface of said substrate and having a first curved edge, a lower planer conducting antenna element disposed on the adjacent side of said substrate and having a second curved edge in close proximity to said first curved edge and spaced apart therefrom to define a gap at a point of closest proximity therebetween with each antenna element and its associated curved edge on different sides of the substrate, each curved edge gradually tapering outwardly from the gap to define flared notches.

It will be appreciated that the dielectric substrate may be of a very wide range of dielectric material since, in practice, a wide variety of materials will function, including plastic foams, Teflon board, etc. As a result, any dielectric that can properly offer support for the conducting antenna elements will answer.

The two metallizations that make up the conducting patch or antenna element of the subject invention are situated on a substrate such as a planar dielectric substrate and are spaced apart one from the other so that the edges of each metallization that are adjacent one another present curved edges that are separated by varying distances. It will be appreciated from the disclosure herein, that such facing edges of each metallization are curved in either a complimentary manner or noncomplimentary manner. When complimentary, the curved edge has a point along the curve at which the other portion of the curve is the same or substantially the same so that upon being theoretically folded the curved portion would substantially coincide with the other portion. On the other hand, the curves are noncomplimentary if when theoretically folded the curves do not coincide or substantially coincide.

The two metallizations may also be viewed as forming a dual flared notch configuration in which a gap is formed at a relatively narrow portion of the antenna structure and a mouth is formed at a wider portion thereof, the two metallizations having their notch configuration derived commonly from the gap formed therebetween. In one preferred embodiment, the dual flared notch is so designed as to curve exponentially outwardly from the gap portion, the edges of the metallizations facing one another and generally curving outwardly according to a continuous function. This function may be a linear function or a parabolic one.

BRIEF DESCRIPTION OF THE DRAWINGS

FIG. 2*c* being a plan view and FIG. 2*d* being a side view thereof;

FIG. 6 showing the E-plane and FIG. 7 the H-plane pattern;

DESCRIPTION OF THE PREFERRED EMBODIMENTS

Figure 1A:
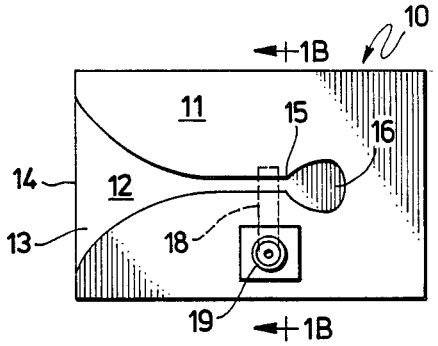
Fig. 1a PRIOR ART
FIG. 1*a* and FIG. 1*b* show a schematic illustration of a prior art single notch radiating element, FIG. 1*a* being a plan view and FIG. 1*b* a side view of said element.
Figure 1B:
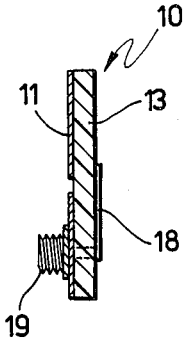
Fig. 1b PRIOR ART
Figure 2A:
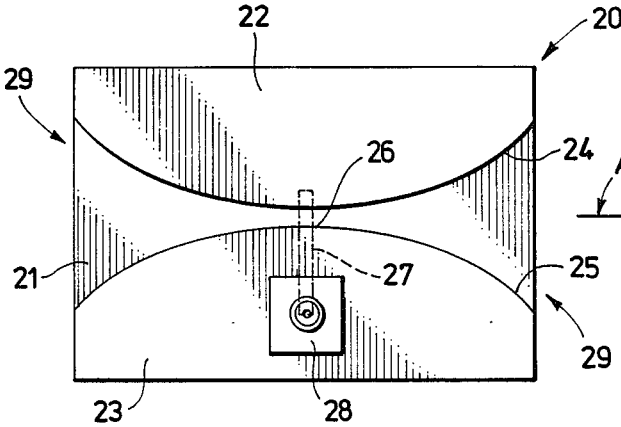
FIGS. 2*a* and FIG. 2*b* show an embodiment of the dual notch frequency independent antenna in a compact form in accordance with the subject invention, FIG. 2*a* being a plan view and FIG. 2*b* being a side view thereof.
Figure 2B:
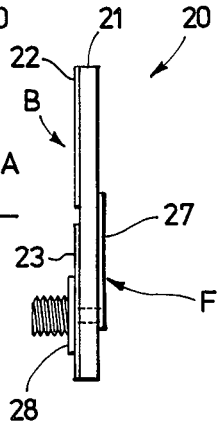

An antenna element of the subject invention is illustrated in FIG. 2*a* and FIG. 2*b*. A dual notch antenna element 20 for receiving and transmitting electromagnetic waves includes a planar substrate 21 such as a microwave dielectric material. Such materials may be composed of a delectric or ceramic material, PTFE composite, fiberglass reinforced with crosslinked polyolefins, alumina and the like. On one side of the surface substrate 21, first and second metallizations 22 and 23, respectively, are bonded thereto. The first and second metallization, 22 and 23, have adjacent and facing edges 24 and 25 that extend across the surface of substrate 21 and curve outwardly and remain spaced apart. It should be appreciated that the edges 24 and 25 are very thin since the metallization is generally deposited by electrochemical deposition. Thus the thickness may be usually about 0.005 inch or less. The two metallizations 22 and 23, approach one another at 26 to form a small spacing or feed-point gap 26 therebetween. The two metallizations form a dual flared notch antenna device in which the gap 26 is formed at the narrow approach between the metallizations and form a mount 29 at the terminal end of each flared notch. The two flared notches are both interrelated at and emanate from the same gap. In this embodiment both flared notches are disposed on a single side of the substrate.

Figure 2C:
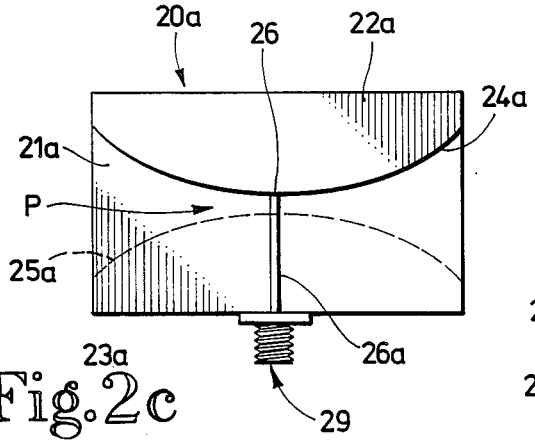
FIGS. 2*c* and 2*d* show a related embodiment of the dual notch frequency independent antenna structure.
Figure 2D:
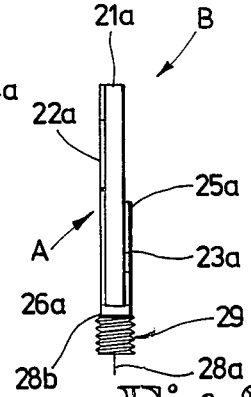

Another preferred embodiment is shown in FIGS. 2*c* and 2*d* showing a plan and side view of the conducting antenna element of the subject invention. FIG. 2*c* shows an antenna element 20*a* for receiving or transmitting electromagnetic waves includes a planar substrate 21*a* such as a microwave dielectric material. As best viewed from FIG. 2d, on one side (A) of the surface of substrate 21*a* is an upper metallization 22*a* integrally formed on said substrate 21*a* and a lower metallization 23*a* spaced from metallization 22*a* and integrally formed on the other side (B) of substrate 21*a*. As viewed from FIG. 2*c* the upper and lower metallization, 22*a* and 23*a*, have adjacent and facing edges 24*a* and 25*a* that extend across different surfaces of substrate 21*a* and curve outwardly from the central portion (P) of the substrate 21*a*. Edges 24*a* and 25*a* are very thin since the metallization is generally accomplished by electrochemical deposition, the thickness being generally about 0.005 inch or less. As can be seen, the two metallizations 22*a* and 22*a* approach one another at gap 26 to form a small spacing. In this particular embodiment a transmission line 26*a* in the form of a thin metal strip is integrally formed with metallization 22*a* and serves, in turn, as an electrical contact with an internal line 28a of a coaxial line 29 and the outer electrical line 28*b* of said line 29 connected to the lower metallization 23*a*. R.F. energy is coupled to the element 20 by means of a microstrip 27 which couples directly to opposite sides of the metallization 22 and 23 in a symmetrically fashion disposed across the gap 26 as is conventionally done with microstrip line coupling. Thus, it will be appreciated that one metallization, say 22*a*, may be on the upper portion of one side (A) of substrate 21*a* and the other, 23b, be on the other side (B) of substrate 21*a* and at the lower portion thereof. The metallizations are therefore separated a very small distance, say about 0.15 inch, by the thickness of the substrate 21*a*, usually a dielectric material. Both metallizations from a dual notch element designed as to curve outwardly (e.g., exponentially) from the gap 26*a*, the edges 24*a* and 25*a* of the metallizations curving or sloping away therefrom. The type of slope or curve can vary over a wide range and one curve does not have to match that of the other. One may be substantially flat and the other substantially curved. In a preferred embodiment, the curves slop outwardly according to a linear or parabolic curve.

Figure 3B:
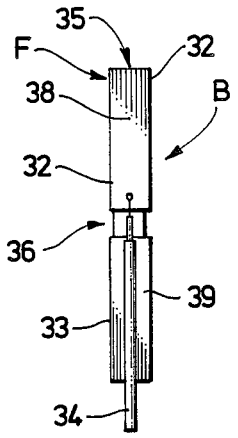
FIG. 3*a*, FIG. 3*b* and FIG. 3*c* are front and side views of the broadband dual notch antenna element in an extremely compact form in accordance with the subject invention.
Figure 3A:
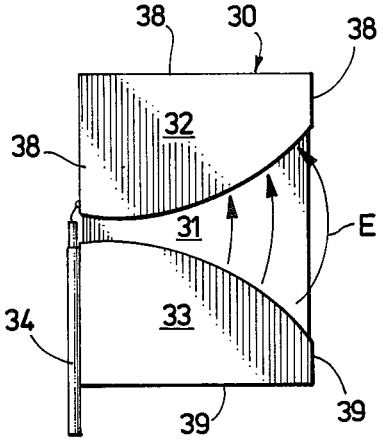
Figure 3C:
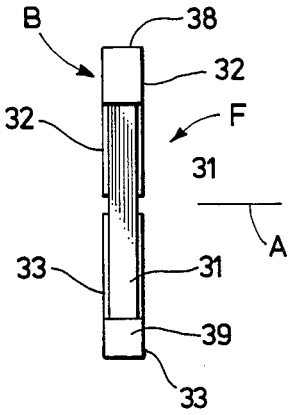

Another preferred embodiment is shown in FIGS. 3*a*, 3*b* and 3*c* in which the previously considered embodiment shown in FIG. 2 has been modified into a further compact dual notch antenna element 30 having a flared notch on each major face of the planer substrate. FIG. 3*a* shows a plan view of the element 30, one major face (B) of which is shown, the substrate 31 having a first and second metallization, 32 and 33, that extend over the minor faces or edges of the substrate 21 and are disposed on the opposite face (F) in an identical manner as on face (B). FIG. 3*b* is a sideview and shows a spacing or feed-point gap 36 between the two metallization, 32 and 33, connected by coaxial line 34.

FIG. 3*c* further depicts conductive connectors 38 and 39 that electrically couple the two complementary halves of metallization 32 and 33, respectively. Thus, in this embodiment the complementary halves along with the conductive connectors define two very narrow enclosures whose only opening is the flared notch. In FIG. 3*a* the E-vector component is shown by field lines designated by the letter E.

Figure 4A:
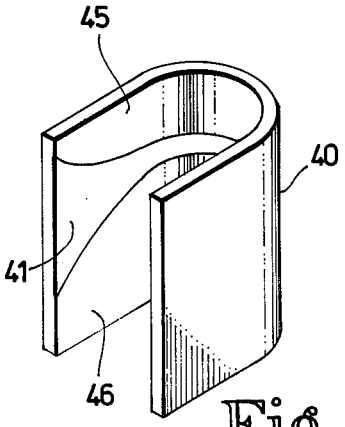
FIG. 4*a* and FIG. 4*b* are two views showing, respectively bent or folded dual notch radiating elements in accordance with the subject invention.
Figure 4B:
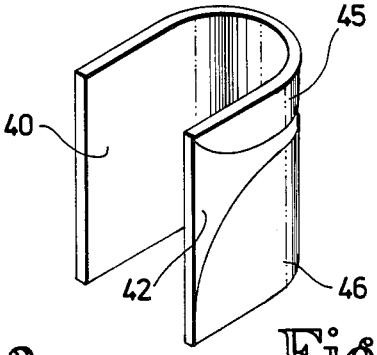
Figure 5:
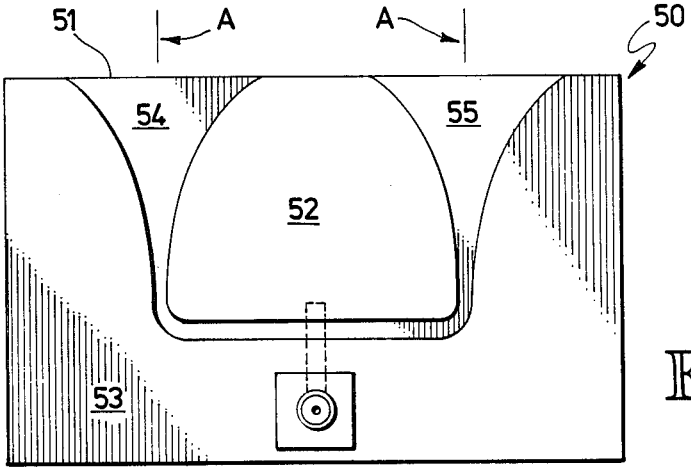
FIG. 5 shows yet another embodiment of the dual notch broadband antenna element having a phase difference over its entire bandwidth in accordance with the subject invention.

An interesting and advantageous aspect of the subject invention is the ability of the planer dual notch antenna structure of the subject invention to be actually bent or folded transversely across the narrow slot portion to produce various degrees of a side by side dual flared notch antenna. FIG. 4*a* and 4*b* show that the coupled flared notches, 41 and 42, formed by metallizations 45 and 46 may be configured when so folded or bent on the internal or external surface of the substrate 40. In a further embodiment of the subject invention the coupled flared notch configuration may be so designed so that a relatively longer interconnecting slot separate the metallizations that are spaced apart at some predetermined distance and orientation. For example, FIG. 5 shows a dual flared notch antenna 50 in accordance with the subject invention in which a planar substrate 51 is provided with metallizations 52 and 53 in which the axis A of the flared notches 54 and 55 are in alignment and are fed 180° out of phase over the entire bandwidth to provide a frequency independent radiator device.

It will be appreciated that although an exponential curve has been suggested herein that in practice an infinite number of curves will operate and the subject invention is not limited to any specific family of curves. Moreover, although the folded antenna structure has been shown to be more or less symmetrical in the manner of bending the subject antenna structure there are an infinite number of ways of folding, bending rolling, etc., the structure and although the linear and paralolic curves are highly useful there are many curvilinear configurations that one skilled in the art would readily consider that would prove useful. As for the dielectric material or substrate, a number of materials will work including PTFE, Styrofoam, Rohocell and others but it should be recognized that the main reason for the substrate is to merely hold, support or maintain the antenna in a predetermined configuration and, hence that a wide range of organic and inorganic substances may be employed.

Figure 6:
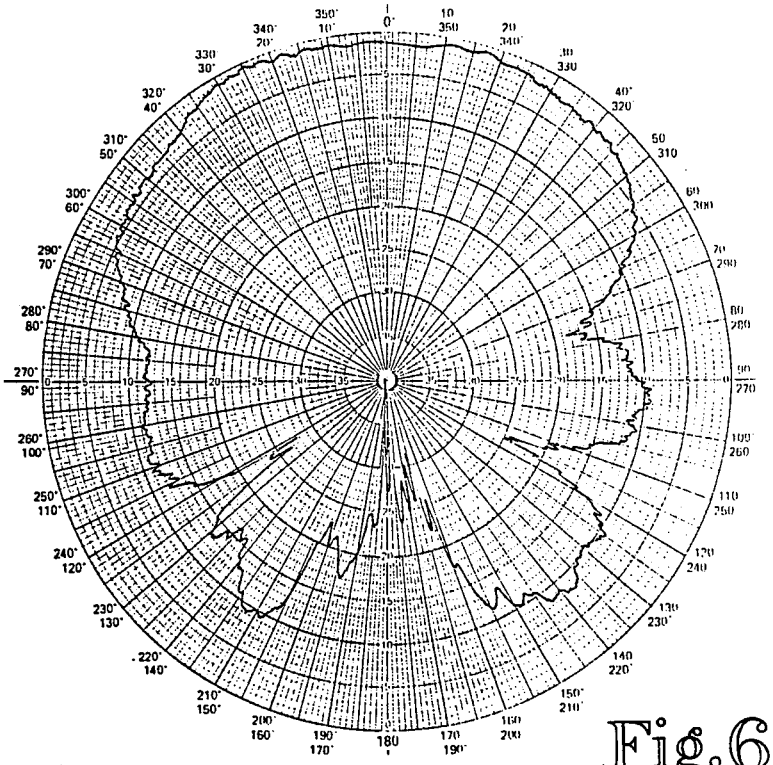
FIG. 6 and 7 are typical radiation patterns for the antenna of FIG. 3.
Figure 7:
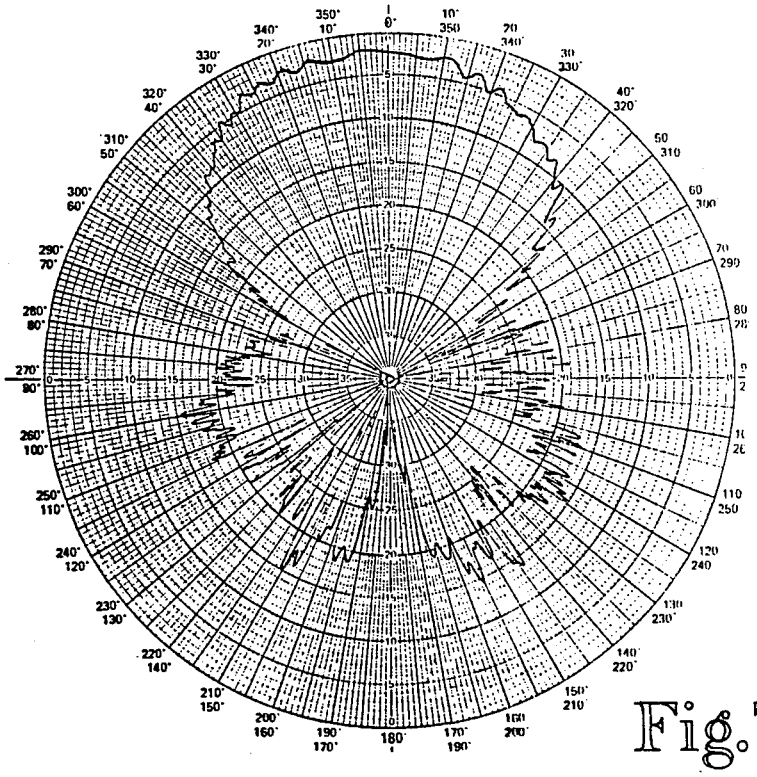
Figure 8:
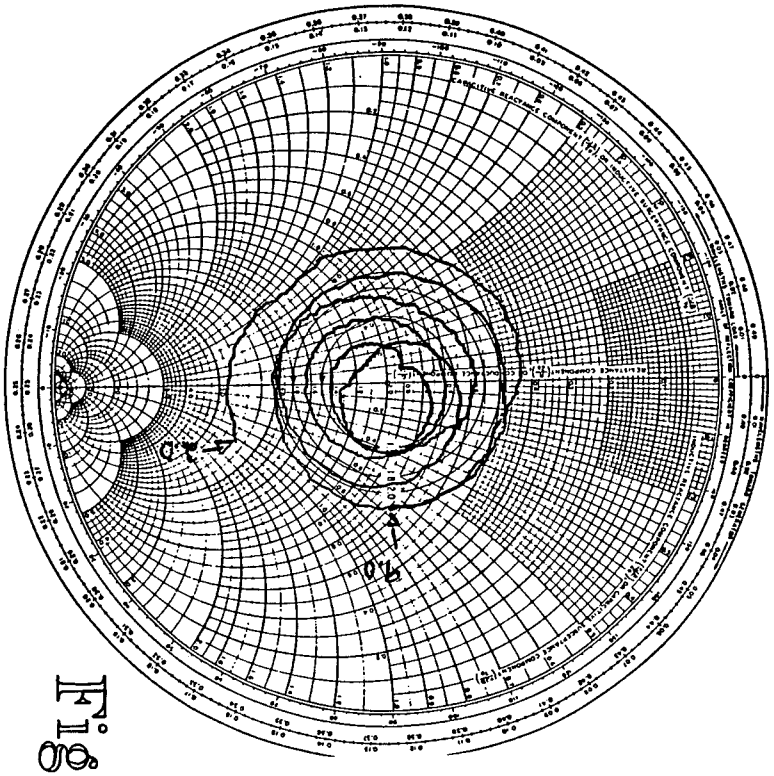
FIG. 8 and 9 are two typical transmission line charts showing the VSWR from 2 to 9 GHz and from 9 to 18 GHz of the antenna structure shown in FIG. 3.
Figure 9:
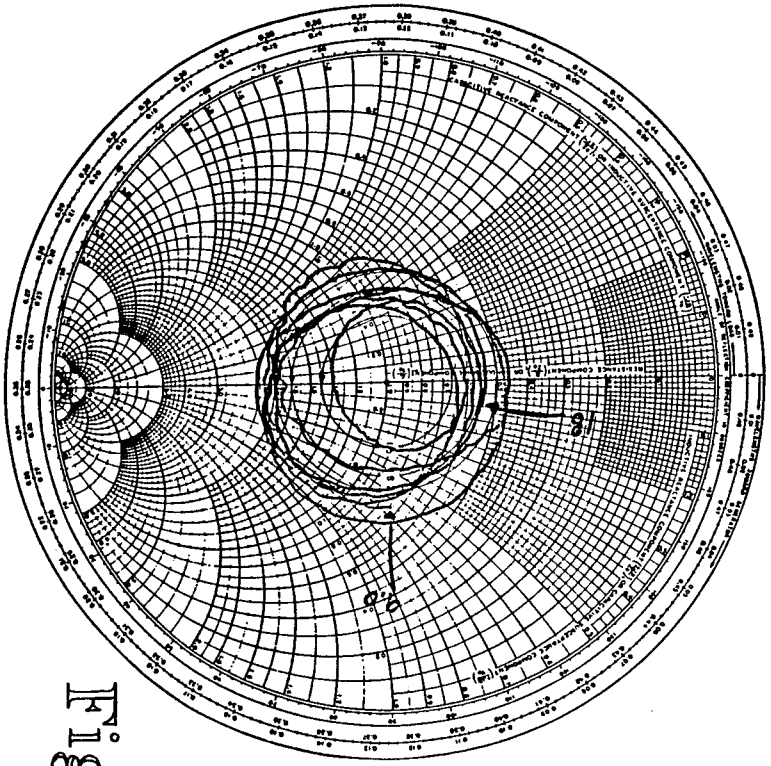

An antenna of the type of FIG. 3*a* was constructed with the following physical and electrical properties:

Length×Width×Height=2.13″×1.75″×0.125″
Mouth=1″
Gap=0.06″
Feed means=coaxial line
Substrate=Teflon board No. 10
Radiation pattern as shown in FIGS. 6 and 7, E and H planes, respectively is highly directive with a well defined major lobe accompanied by two minor lobes. Radiation shape: Cardioid pattern.
Front and rear ratio: 10 dB
Polarization: linear
VSWR: less than 3.0:1, 2 to 18 GHz FIG. 8 shows a VSWR from 2 to 9 GHz and FIG. 9 shows a VSWR from 9 to 18 GHz.)

The dual flared notch antenna device 30 is generally fed by a coaxial line 38 and, so when fed with R.F. energy, it creates a near field across the discontinuity of the flared notch which thereby established the propagation of far field radiation. It will be appreciated that the polarization of such a notch antenna device is somewhat analogous to that of a simple dipole antenna in that radiation is launched linearly from the notch with the E-vector component lying in the plane of the dielectric substrate and the H-vector component being, of course, at right angle thereto.

A coaxial line or other suitable transmission line structure delivers the power to a finite active region of the dual notch antenna structure. The active region radiates most of the power of a given frequency. It may be visualized that the center of the active region would fall on points along the notch axis A and that such centers for each flared notch are actually electromagnetic phase centers that progress inversely with frequency from the commonly shared feed-point gap as the frequency increases.

It will be appreciated that the novel dual flared notch antenna element of the subject invention may be readily configured into an orthogonally polarized interleaved array. As is known the radiation pattern of an array depends upon the relative positions of the individual elements, the relative phases of the currents or fields in the individual elements, the relative magnitudes of the individual element currents or fields and the patterns of the individual elements. The radiated field from the array at a given point in space is the vector sum of the radiated fields from the individual elements.

Figure 10B:
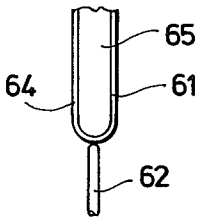
FIG. 10*b* shows a sectional view taken along 10B—10B of FIG. 10*a*.
Figure 10A:
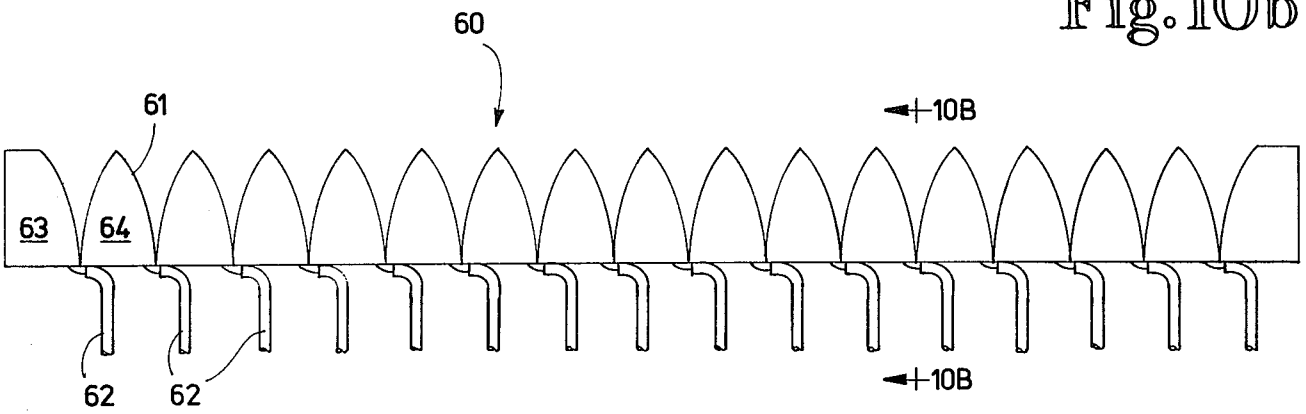
FIG. 10*a* shows a linear array of antenna elements in accordance with the subject invention.
Figure 12:
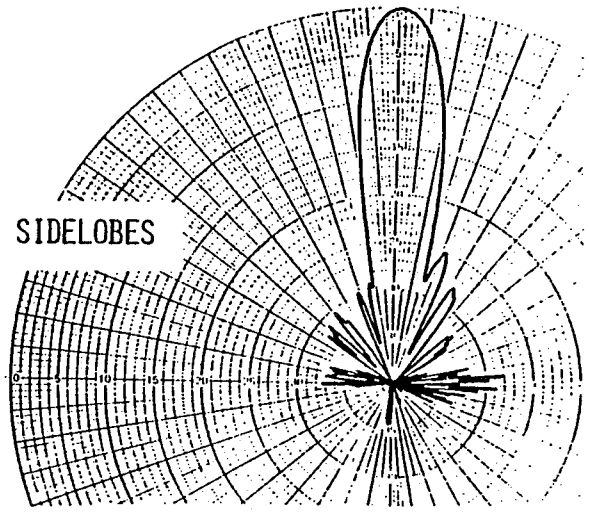
FIG. 11 and 12 show broadwide radiation patterns of 6 GHz and 10 GHz, respectively, for the linear array antenna of FIG. 10*a* and 10*b*.
Figure 11:
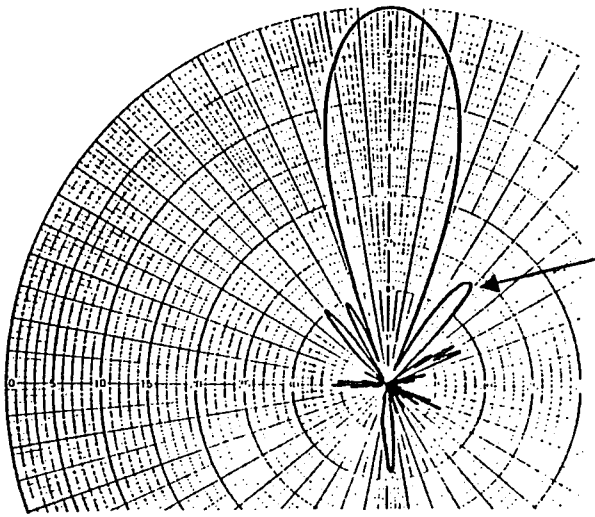

FIG. 10*a* depicts a linear array 60 of elements in accordance with the subjection invention, the array presenting sixteen dual notch antenna elements 61. Each dual notch antenna element 61 is provided with a coaxial cable 62 that couples the individual metallizations 63 and 64 of each antenna element 61. The coaxial cable is generally connected to a conventional power divider or combiner (not shown). FIG. 10*b* shows a cross sectional view of an element 61 of the array, the metallization 64 making a U-shaped configuration and being supported on a substrate 65. FIGS. 11 and 12 show a broadside radiation pattern of the sixteen dual notch linear array of FIG. 10*a* at 6 GHz and 10 GHz. The main beam of the radiation patterns may be considered to be especially a wide element beam having a substantially narrow beam in one direction and a broad one at right angles thereto.

Figure 14:
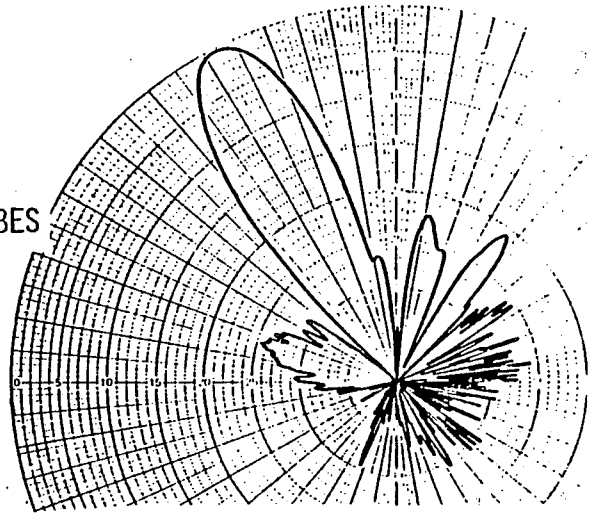
FIG. 13 and 14 show radiation patterns at 6 GHz and 10 GHz for the linear array of FIG. 10*a* slanted at 27°.
Figure 13:
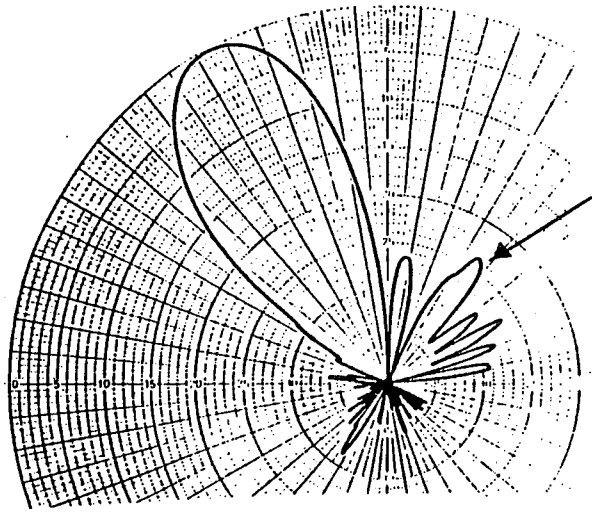

The sidelobe level of the antenna pattern may be defined as the ratio in decibels of the amplitude at the peak of the main beam to the amplitude at the peak of the sidelobe in question. As can be observed from the radiation pattern, the sidelobes are appended to the main beam, with the first sidelobes being adjacent to the main beam and arranged on either side. FIGS. 13 and 14 show radiation patterns at 6 GHz and 10 GHz for a 27° beam for the linear array antenna shown in FIG. 10*a*.

The foregoing detailed description has been given for clearness of understanding only, and no unnecessary limitations should be understood therefrom, as modifications will be obvious to those skilled in the art.

What is claimed is:

1. An antenna structure for receiving or transmitting electromagnetic waves comprising a substrate having an outer surface, a first conducting radiator disposed on one side of the outer surface of said substrate and having a first curved edge, a second conducting radiator disposed on the other side of the outer surface of said substrate and having a second curved edge, said first and second curved edges being closely related to one another and spaced apart in close proximity at one point to define a feed-point gap therebetween with adjacent curved edges gradually tapering outwardly therefrom to define first and second continuous flared notches interfacing one another and emanating from said feed-point gap.

2. An antenna as recited in claim 1 wherein the first and second radiators are metallizations bonded to said substrate by electrodeposition.

3. An antenna as recited in claim 1 wherein each notch is defined by a pair of curved metallizations converging towards the feed-point gap.

4. An antenna as recited in claim 1 wherein the flared notches are both disposed in a common plane.

5. An antenna as recited in claim 1 wherein the flared notches are in parallel planes spaced apart at a distance substantially less than a quarter wavelength.

6. A nonresonant antenna having a radiation pattern and impedance characteristics that are essentially independent of frequency over a wide bandwith comprising a support substrate, a first metallization disposed on the surface of said substrate and having a first curved edge, a second metallization disposed on the substrate and having a second curved edge, said first and second curved edges being closely related to one another and spaced apart from a feed-point gap, the curved edges of each metallization gradually tapering outwardly from said gap to define a pair of continuous dual flared notches.

7. An antenna as recited in claim 6 wherein the curved edges defining the notches flare outwardly according to a continuous parabolic function.

8. An antenna as recited in claim 7 wherein the notches flare outwardly according to a continuous linear function.

9. An antenna as recited in claim 6 wherein the substrate comprises a material selected from the group consisting of polytetrafluoroethylene, fiberglass, and alumina.

10. An antenna structure for receiving and transmitting electromagnetic waves comprising a substrate, an upper planar conducting antenna element on one side of the surface of said substrate and having a first curved edge, a lower planar conducting antenna element disposed on the adjacent side and having a second curved edge closely related to the first curved edge in close proximity and spaced apart from each other to define a feed-point gap at a point of closest proximity therebetween with each antenna element and its associated curved edge on different sides of the substrate, each curved edge gradually tapering outwardly from the gap to define first and second continuous flared notches.

11. An antenna structure as recited in claim 10 wherein the antenna elements are electrically coupled to a metallized transmission line.

12. An antenna structure as recited in claim 10 wherein the antenna elements are electrically coupled to a coaxial cable.

* * * * *